United States Patent [19]

Schrader et al.

[11] 4,094,074

[45] June 13, 1978

[54] METHOD AND ARRANGEMENT FOR DRYING ARTICLES

[75] Inventors: Alfons Schrader; Waldemar Schreiner; Anton Gessner, all of Remscheid-Lennep, Germany

[73] Assignee: Buttner-Schilde-Haas AG, Krefeld-Uerdingen, Germany

[21] Appl. No.: 729,144

[22] Filed: Oct. 4, 1976

[30] Foreign Application Priority Data

Oct. 4, 1975 Germany ..... 2544589

[51] Int. Cl.[2] ..... F26B 3/00

[52] U.S. Cl. ..... 34/33; 34/155; 34/158

[58] Field of Search ..... 34/33, 155, 158

[56] References Cited

U.S. PATENT DOCUMENTS 2,265,071 12/1941 Hartenbach, Jr. ..... 34/158

3,739,490 6/1973 Comstock ..... 34/155

FOREIGN PATENT DOCUMENTS 1,460,687 1/1970 Germany ..... 34/155

*Primary Examiner*—John J. Camby

*Attorney, Agent, or Firm*—Michael J. Striker

[57] ABSTRACT

Articles to be dried are conveyed through a tentering frame in a path. Air is heated and then directed into contact with the articles in direction transversely of the path. The air is directed by at least one crossflow blower unit and a plurality of channel elements, each of which has a foraminous wall which faces the articles passing through the frame. The blower is driven by a motor drive which is operative for circulating the heated air in direction through the blower unit and into the channel elements. Thereupon, the air passes through the respective foraminous walls to impinge against and thereby dry the articles.

10 Claims, 2 Drawing Figures

METHOD AND ARRANGEMENT FOR DRYING ARTICLES

BACKGROUND OF THE INVENTION

The present invention relates to a method and arrangement for drying articles and, more particularly, to tenters having articles such as cloth which are to be dried.

Tenters are generally known in the prior art for drying and stretching cloth which is mounted on a frame. The cloth is mounted in taut condition with the aid of tenterhooks and conveyed by chain drives or the like through the frame. For drying purposes, the prior art has employed axial-and radial-blowers for circulating air against the articles. However, the prior art arrangements have proven unsatisfactory in providing uniform and even drying of the cloth.

It is frequently necessary to arrange a multitude of blower units underneath and/or above the articles to achieve uniform drying over all areas of the cloth. Such complex arrangements have proven very cumbersome and expensive. Additional blower units are often necessary. For maintenance purposes, the complex prior art arrangements do not provide easy access for a workman.

SUMMARY OF THE INVENTION

Accordingly, it is the general object of the present invention to overcome the disadvantages of the prior art.

An additional object of the present invention is to improve the efficiency of prior arrangements.

Still another object of the present invention is to reliably and uniformly dry articles in drying arrangements.

Another object of the present invention is to provide a simple and inexpensive arrangement for drying articles.

In keeping with these objects and others which will become apparent hereinafter, one feature of the invention resides, briefly stated, in an arrangement for drying articles which comprises means for conveying the articles to be dried in a path through a frame, and means for directing air into contact with the articles which includes crossflow blower means operative for circulating air in direction transversely of the path so as to uniformly dry the articles passing through the frame.

The cross-flow blower means may comprise a single blower which extends over the entire length of the arrangement, or a plurality of such blower units which together extend over the entire length of the arrangement. The blower units may be driven by a common drive or may be independently-operable by separate drives. Each unit is operated at relatively high volumetric flow output rates and at high pressures.

In further accordance with the invention, a plurality of channel elements are arranged above and below the articles passing through the frame in direction of the path. Each channel element has a foraminous wall which faces the articles passing through the same. Each channel element has a generally wedge-shaped cross-section which modifies the flow of air flowing therethrough such that the air passing through the foramina of the wall of a respective element has an exit velocity of approximately 40 m/sec at a pressure of 100 mm water column measured at 20° C. Heating means are also provided which preferably heat the air in the arrangement to a temperature of about 250° C.

Still further in accordance with the invention, the heating means and the cross-flow blower means are mounted at separate locations within the arrangement. This feature assures easy access to workmen in case the single blower must be exchanged with another, or in case one of the plurality of blower units must be similarly interchanged for maintenance purposes. In the latter case, it is preferable if the overall length of a single blower unit be about 2.5 meters, thus having an effective blade length of approximately 2.3 meters.

The use of the aforementioned cross-flow blower means results essentially in the advantage that a uniform and even flow of drying air can be directed towards the articles in a drying arrangement. Thus, the efficiency of tenters has been dramatically improved.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DESCRIPTION OF THE PREFERRED EMBODIMENT

Figure 1:
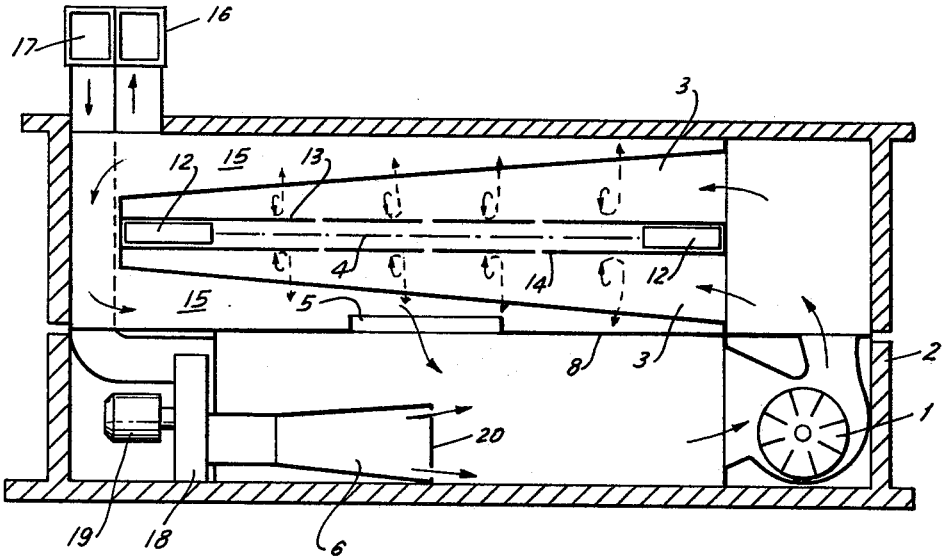
FIG. 1 is a cross-sectional view of a perferred embodiment according to the present invention.

Referring jointly to the method and arrangement for drying articles, it will be seen that reference numeral 10 generally identifies the housing or frame in which the articles are to be dried. The articles, diagrammatically identified by reference numeral 4, are conveyed in a path in direction of arrow 9 (FIG. 2) through frame 10. The articles are supported in taut condition by support members 12 which are movable by chain drives or analogous transport means through the frame 10. Additional details of the support members and the transport drive are not believed to be necessary since they are entirely conventional in the art and form no part of the present invention.

In accordance with the invention, air is directed against the articles 4 for contact therewith. Thus, the cross-flow blower means 1 of FIG. 1 is operative for circulating air in direction of the arrows into the interior of channel or nozzle elements 3. Elements 3 are successively arranged in direction of the path across the entire length of the frame 10. Similarly, the cross-flow blower means 1 of FIG. 1 which comprises a single blower unit also extends over the entire length of the frame.

Each channel element 3 has a foraminous wall which faces the articles. Thus, the upper wall 13 faces the upper side of the articles 4; and the lower wall 14 faces the lower side of the articles 4. In operation, the air flowing within the elements 3 exit through the foramina of walls 13, 14 and impinge in generally vertical direction against both sides of the articles. After impingement, the air is collected in region 15, whereupon a minor portion, e.g. 1/10 of the air, is discharged through exhaust outlet 16 and the remaining portion of air is discharged through discharge outlet 5 of the wall 8 for recirculating back towards the blower 1.

Heater 6, preferably a gas burner or heat exchanger or analogous heating device, is located in a section of the frame 10 remote from the section 2 in which the blower 1 is mounted. This assures easy access to the various component parts of the arrangement. Heater 6 utilizes fresh air from intake 17 to feed burner 18. Motor 19 is operative to discharge the heated combustion gases towards and past the baffle 20 in direction towards blower 1 for circulation through the arrangement.

Figure 2:
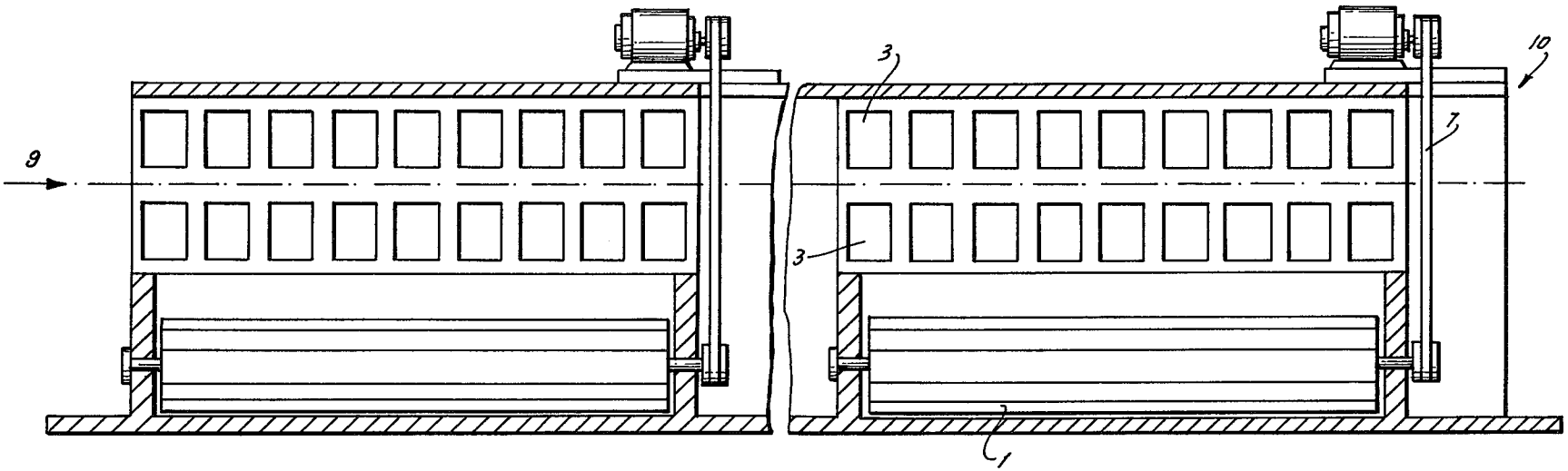
FIG. 2 is a longitudinal section of the embodiment of FIG. 1.

The cross-flow blower means may comprise a single blower, as shown in FIG. 1, or a plurality of such blower units, as shown in FIG. 2. The blower units may be driven by a common drive or they may be independently operable by separate drives. For example, in FIG. 2, one such motor drive 21 is shown coupled by belt 7 to one of the blower units. It will be understood that additional motor drives will be provided to drive the remaining blower units.

It will be understood that each of the elements described above, or two or more together, may also find a useful application in other types of constructions differing from the types described above.

While the invention has been illustrated and described as embodied in a method and arrangement for drying articles, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. Arrangement for drying articles, particularly a tenter, comprising a frame; means for conveying articles to be dried in a path through said frame; means for heating air in the frame; and means for directing the heated air into contact with the articles, including cross-flow blower means and a plurality of foraminous channel elements, said cross-flow blower means being operative for circulating air into said channel elements and from there through the foramina of the latter in direction transversely of said path so as to uniformly dry the articles passing through the frame.

2. The arrangement of claim 1, wherein said channel elements are arranged in direction of said path, each channel element having a foraminous wall which faces the articles passing through the frame.

3. The arrangement of claim 2, wherein each channel element has a wedge-shaped cross-section which modifies the flow of air flowing therethrough such that the air passing through the foramina of said wall of a respective element has an exit velocity of about 40 m/sec at a pressure of 100 mm water column measured at 20° C.

4. The arrangement of claim 3: wherein said heating means heat the air to a temperature of about 250° C.

5. The arrangement of claim 1, wherein said cross-flow blower means comprises a plurality of blower units each arranged adjacently of one another across the entire length of said frame.

6. The arrangement of claim 5; and further comprising means for driving said cross-flow blower means at high pressure and at large volumetric air outputs, said drive means comprising a plurality of drive units each unit operative for driving a respective one of said blower units.

7. The arrangement of claim 1, wherein said cross-flow blower means comprises a single blower unit; and further comprising means for driving said blower unit at high pressure and at large volumetric air output.

8. The arrangement of claim 1, wherein said cross-flow blower means comprises a single blower unit; said heating means being located in one housing section of said frame for heating said air; and also comprising means for mounting said blower unit in another housing section of said frame which is remote from said one housing section of the latter.

9. The arrangement of claim 1, wherein said cross-flow blower means comprises a single blower unit having an overall length of about 2.5 meters and a blade length of about 2.3 meters.

10. Method of drying articles in a drying arrangement, particularly a tenter, comprising conveying articles to be dried in a path through the drying arrangement; heating air in the drying arrangement to a temperature of approximately 250° C; directing the heated air into contact with the articles to be dried by circulating air with cross-flow blower means in direction transversely of the path at a velocity of 40 m/sec and at a pressure of 100 mm water column measured at 20° C.

* * * * *